United States Patent [19]

Fridge

[11] Patent Number: 4,784,275

[45] Date of Patent: Nov. 15, 1988

[54] VERIFICATION SYSTEMS FOR SMALL OBJECTS

[75] Inventor: D. Alan Fridge, La Canada, Calif.

[73] Assignee: Vanzetti Systems Inc., Stoughton, Mass.

[21] Appl. No.: 907,482

[22] Filed: Sep. 15, 1986

[51] Int. Cl.[4] ..... B07C 5/08; B07C 5/342

[52] U.S. Cl. ..... 209/558; 209/580; 209/586; 209/644

[58] Field of Search ..... 209/539, 552, 555, 556, 209/558, 576, 577, 580, 581, 586, 587, 588, 644, 923, 932; 250/226; 356/425; 364/580, 579

[56] References Cited

U.S. PATENT DOCUMENTS

| | | | |
|---|---|---|---|
| 2,929,500 | 3/1960 | Warner | 209/581 |
| 3,097,743 | 7/1963 | Scholten et al. | 209/577 X |
| 3,245,533 | 4/1966 | Rottmann | 209/587 X |
| 3,393,800 | 7/1968 | Durand, Jr. | 209/581 |
| 4,143,770 | 3/1979 | Grimmell et al. | 209/580 X |
| 4,436,207 | 3/1984 | Klukis | 209/587 X |
| 4,635,111 | 1/1987 | Moore | 209/587 X |

FOREIGN PATENT DOCUMENTS

| | | | |
|---|---|---|---|
| 0117402 | 9/1984 | European Pat. Off. | 209/576 |
| 3140019 | 4/1983 | Fed. Rep. of Germany | 209/565 |
| 0200863 | 6/1983 | Fed. Rep. of Germany | 209/577 |
| 2095823 | 10/1982 | United Kingdom | 209/577 |

*Primary Examiner*—Robert B. Reeves
*Assistant Examiner*—Edward M. Wacyra
*Attorney, Agent, or Firm*—Sughrue, Mion, Zinn, Macpeak & Seas

[57] ABSTRACT

A verification system for capsules, tablets and the like includes a test block having a slot through which the capsules are directed by a conveyor. The test block includes first and second spaced sensing planes each having bifurcated fiber optic input and output arrays on the top and both sides of the slot. An optical system provides a planar light beam for sensing the position of the capsules being tested at the output from the test block. The length of the capsule is determined from the speed of the conveyor and the time of interruption of planar light beam. If the capsule is not of the proper colors and length, it is pneumatically ejected into a rejection chute.

19 Claims, 5 Drawing Sheets

VERIFICATION SYSTEMS FOR SMALL OBJECTS

FIELD OF THE INVENTION

This invention relates to a verification system for capsules, tablets, or other small similar objects.

BACKGROUND OF THE INVENTION

It has been previously been proposed to inspect capsules and tablets automatically, and one prior system for accomplishing this function is disclosed in an article entitled "Automatic Color Inspection For Pharmaceuticals", by John J. Lee, Jr., Pharmaceutical Engineering, January–February, 1985. However, prior systems such as that disclosed in the above-identified article were somewhat inflexible, in that separate testing heads or "set-ups" were required for translucent capsules, as compared with opaque capsules, and the capsule position sensing arrangements were relatively coarse, and overly critical in their required adjustments.

Accordingly, the principal object of the present invention is to provide a verification system for small objects, such as capsules or tablets, which is simpler, more reliable, and more versatile than previously proposed systems, and one which will measure the length of the objects, in addition to the color testing of the capsules or similar small objects.

SUMMARY OF THE INVENTION

In accordance with a specific illustrative embodiment of the invention, the verification system for capsules, tablets, or the like, may include a test block having a slot through which the objects to be tested are moved by a conveyor or the like, and arrangements for providing first and second spaced color testing zones within the test block, with the two test zones being spaced apart by approximately the distance between the first and second parts of standard two color capsules to be tested. A fiber optic array is coupled to each of the two spaced color testing zones and includes arrangements for directing light to top and both sides of a capsule, and for receiving reflected and/or transmitted illumination from the top and both sides of the test zone, and for coupling this received illumination to a high speed spectrometer.

A substantially vertically extending planar light beam is employed to detect the front end of the capsule at the time that the two differently colored sections of the capsule are substantially centrally located in the two color testing zones. If the color of the capsule or other object do not match the previously "learned" spectral characteristics of the two parts of the capsule, ejecting arrangements are provided to separate the "stranger" from the capsules having matching characteristics.

In accordance with another aspect of the invention, arrangements are provided to determine the velocity of the capsules through the test zone, and data processing arrangements are provided for noting the times of interruption of the planar light beam, and for determining the length of the capsule from the velocity and time interval data. If the length of the capsule or other object does not fall within certain predetermined limits, the capsule is ejected. The velocity determination may be made using a pulse generator or tachometer associated with a conveyor belt by which the capsules may be carried through the test block.

The ejection mechanism for "strangers" is preferably pneumatic, whereby the erroneously colored objects or those with incorrect lengths, are deflected into a "reject" container.

In accordance with another feature of the invention, the system may include a preliminary "learn" mode, wherein standard capsules having the correct length and colors are initially fed through the machines, and the system stores the spectral information on both halves of the capsule, in addition to the length information, for reference during the "inspect" mode. The "learn" mode includes the sampling of at least 16 objects or capsules oriented in each of two directions, and an averaging of the spectral characteristics.

Other objects, features and advantages of the invention will become apparent from a consideration of the following detailed description and from the accompanying drawings.

BRIEF DESCRIPTIONS OF THE DRAWINGS

Figure 10:
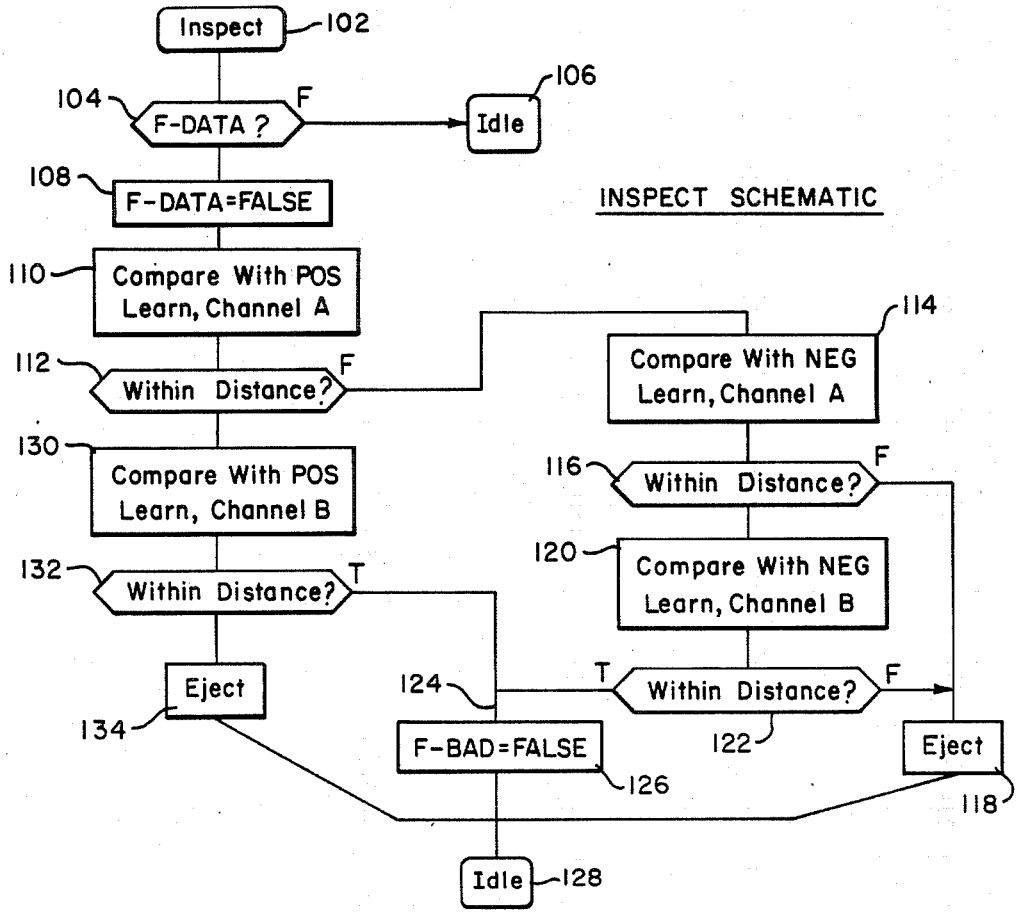
Figure 12:
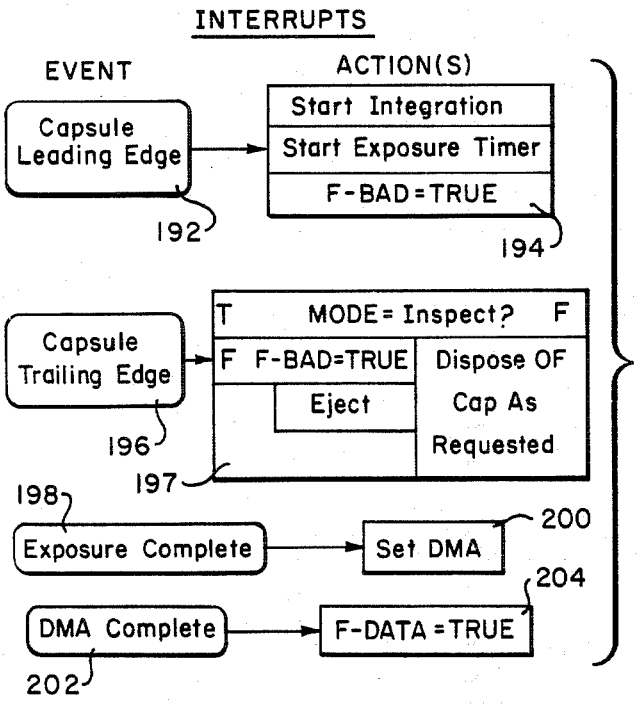
Figure 13:
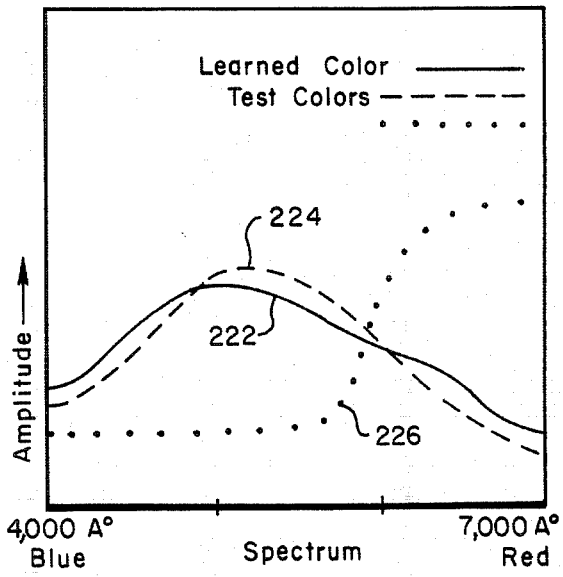
Figure 11:
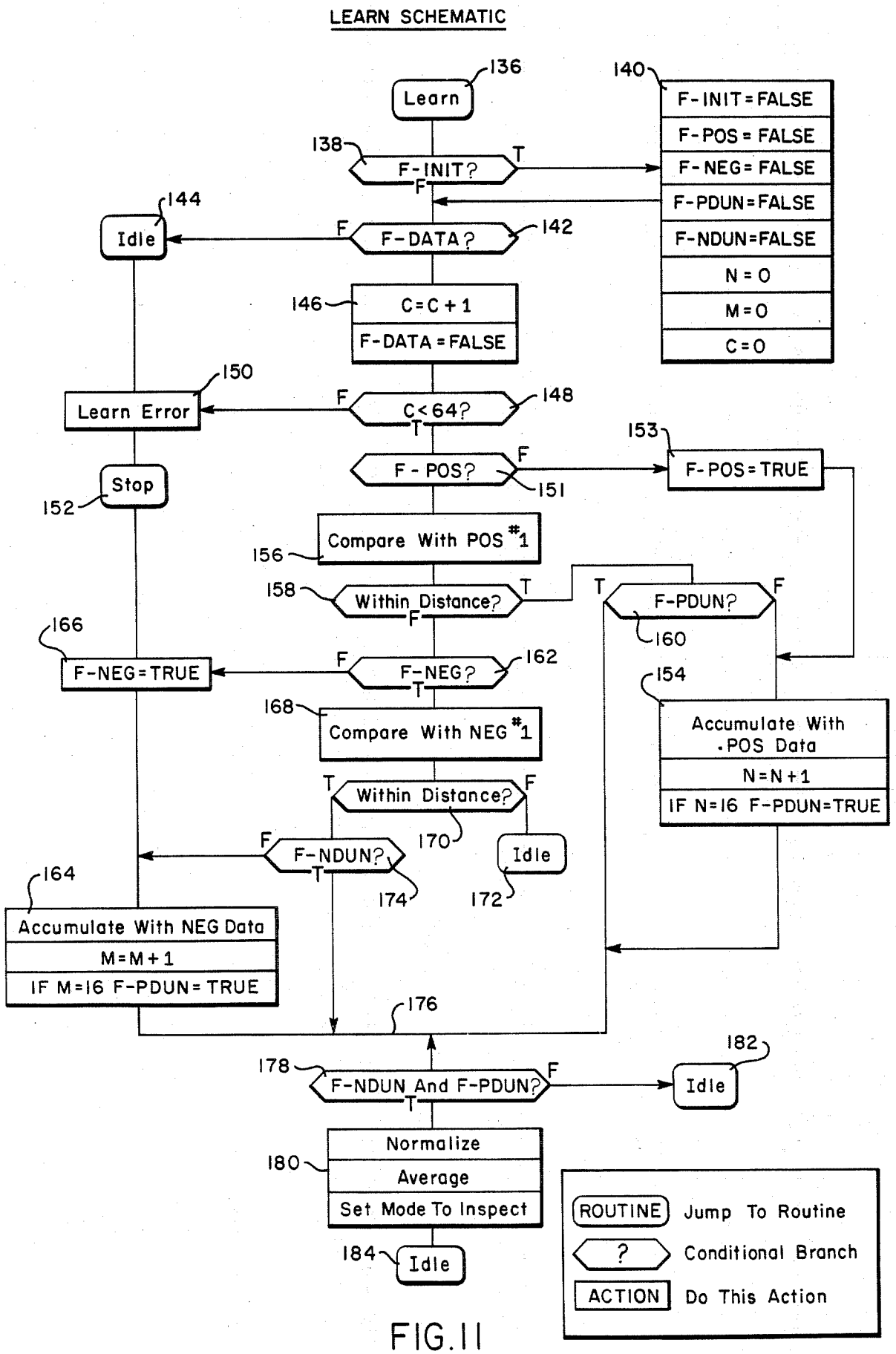

FIGS. 10, 11 and 12 indicate the data processing steps involved in the operation of the system; and FIG. 13 shows a series of plots of amplitude versus spectral wavelength for typical objects being examined.

DETAILED DESCRIPTION OF PREFERRED EMBODIMENT

Figure 1:
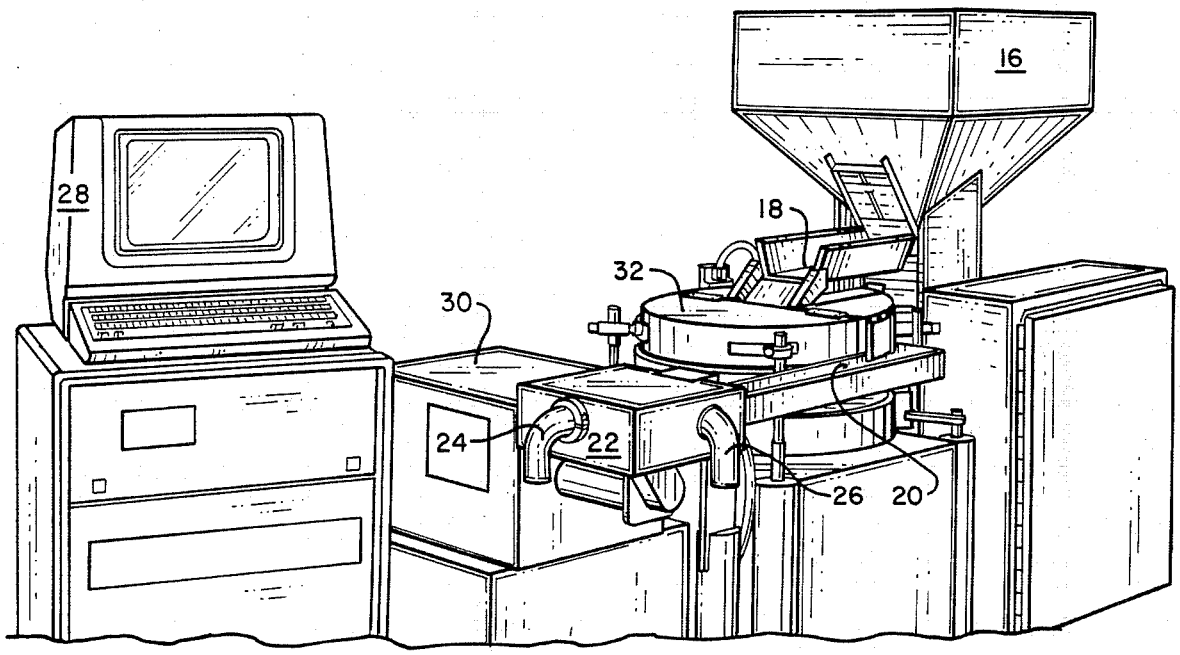
FIG. 1 is an overall system view of a verification system for small objects, illustrating the principles of the present invention.

Referring now to FIG. 1, the system for inspecting capsules, tablets, or other small objects includes an input hopper 16, having a vibratory feeder 18, and a rotary bowl 32 which feeds capsules one by one to a conveyor belt 20 having sides to retain the capsules and to funnel them to the test block which is included within the housing 22. Verified capsules having the proper color and length are directed to the output tube or chute 24 for validated capsules. On the other hand, the output tube or chute 26 receives "strangers" or capsules having colors or a length which does not meet predetermined spectral characteristics or a predetermined length range. Each ejection is accomplished pneumatically, as discussed hereinbelow. A data processor 28, with its associated display and keyboard, receives the signals derived from the test block to be discussed in detail hereinbelow, and provides the appropriate control signal to the pneumatic ejector, when the capsule does not meet the spectral characteristic or length tolerances previously established. Further, the spectrophotometers, within the housing 30 located behind the unit 22, provides the spectral analysis of the two portions of the capsule.

Figure 2:
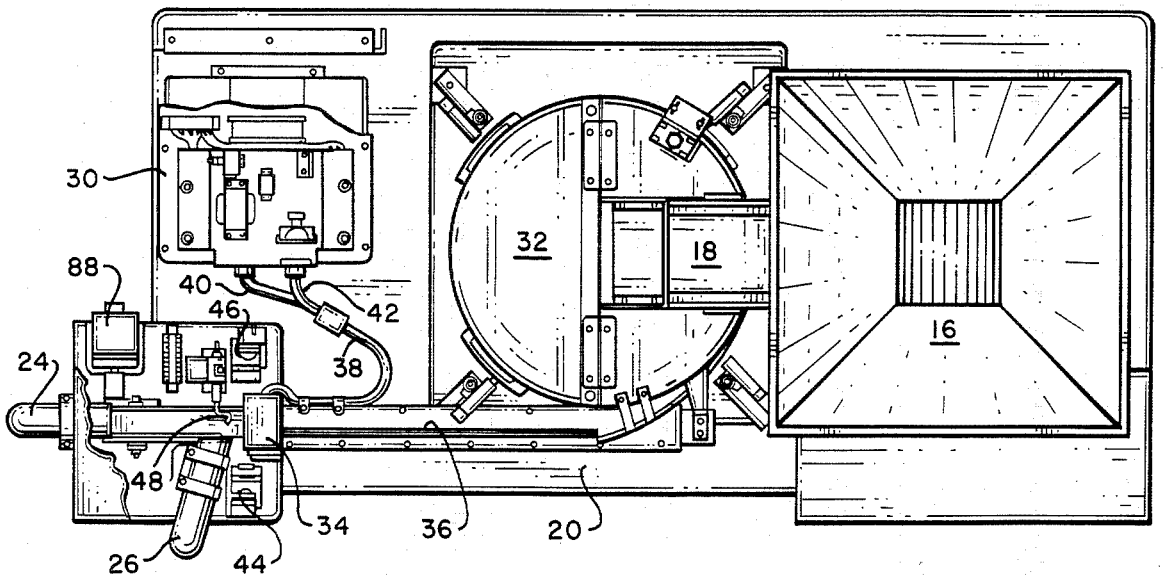
FIG. 2 is a top view of a portion of the system of FIG. 1.

FIG. 2 is a top view of a portion of the system of FIG. 1, showing the bin 16 to the right, having the chute 18 extending outwardly to the rotating bowl feeder 32 which directs capsules or other similar objects one-by-one onto the conveyor assembly 20. In addition, at the lower left in FIG. 2 are shown the ejection chute 26, and the dispenser tube for accepted capsules designated by reference number 24. A key component shown in FIG. 2 is the test block or test station 34 to which capsules are routed one at a time by the conveyor assembly 20 including the guide rails 36. The test block 34 will be described in greater detail herein below, but it includes two zones wherein spectrometer color tests are conducted through the use of the fiber optic cables 38, and its two branches 40 and 42. In addition, optical lens arrangements 44, 46 provide a vertically extending planar light beam at the output or left-hand side of the test block 34. When capsules are found to have an incorrect color, or an incorrect length, these capsules are rejected by an air jet directed through the tube 48 which blows rejected capsules through the conduit 26.

Figure 3:
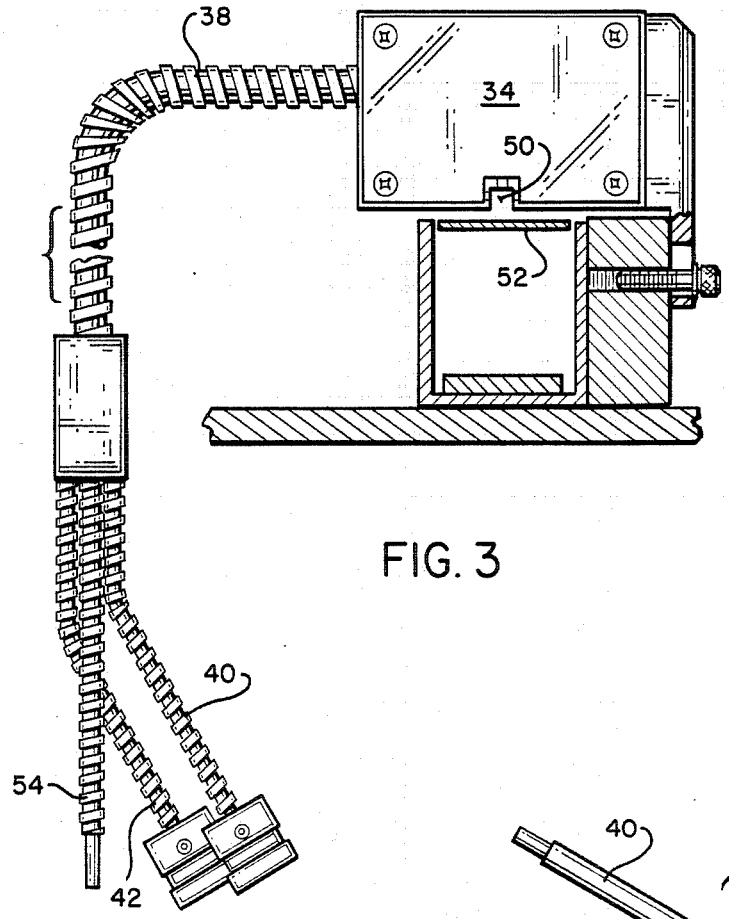
FIG. 3 is an enlarged showing of the test block for small objects and the immediately associated fiber optic and conveyor equipment, shown in partial cross section.

FIG. 3 shows the test block or cell 34 having a central slot 50 through which the capsules or other small objects to be tested are directed, by the moving conveyor belt 52. The fiber optic cable 38 includes three bundles of fibers, as will be discussed in greater detail hereinbelow. Input illumination is directed though the cable 54 to the top and both sides of the slot 50 at two spaced inspection zones along the slot 50. Output spectral information is received at both sides and the top of the slot at both of the two zones, with the bundle included in fiber optic cable 40 bringing color information from one of the two inspection zones, and the cable 42 bringing color information from the other of the two inspection zones to the spectrophotometers. The output from each of the fiber optic cables 40 and 42 is analyzed by the spectrophotometers in housing 30 of FIG. 1, and the results of the analysis are one factor which go into the rejection decision, which is accomplished by an air jet through the tube 48, as mentioned above.

Figure 4:
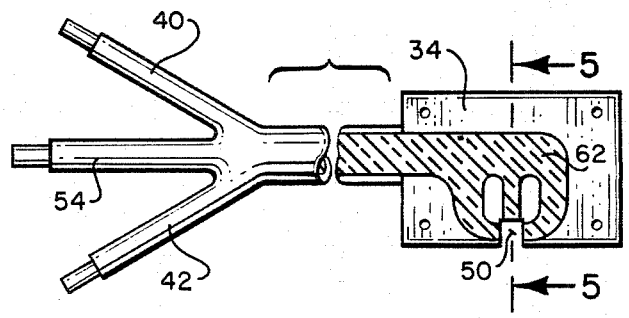
FIGS. 4, 5 and 6 are schematic showings of the test block and fiber optic bundle configurations, with FIG. 4 being a showing transverse to the orientation of the capsules passing through the slot, FIG. 5 being a side view taken along lines 5–5 of FIG. 4, and FIG. 6 being a bottom view of the unit of FIG. 4.
Figure 5:
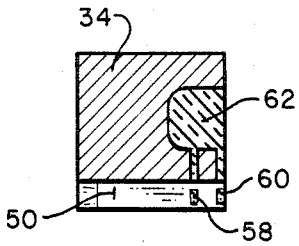
Figure 6:
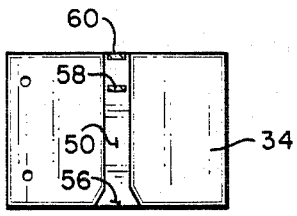

FIGS. 4, 5 and 6 are detailed showings of the test block 34. Starting first with FIG. 6, this is a bottom view of the test block 34 showing the slot 50 through which the capsules or other small objects pass. The entrance 56 is slightly flared to accommodate slight capsule misalignment. The two inspection zones to which the fiber optic cables couple illumination are indicated at 58 and 60 towards the exit end of the slot 50. The showing of FIG. 4 is taken through either of the inspection zones 58 or 60, and includes bundles of optical fibers coupled to the top and to both sides of the inspection zones. At zones 58 and 60 the glass fibers are divided roughly equally between those which bring in illuminating light from the light source, and those which return the reflected or transmitted light to the spectrophotometers for analysis. The central cable 54 is coupled to a source of illumination, and directs input broad band white light to the top and both sides of both of the two inspection zones 58 and 60. The two output cables 40 and 42 are connected, respectively, to the inspection zone 58 or 60. Thus, spectral information supplied to the spectrometer equipment on the fiber optic bundle 40 indicates spectral information from that portion of the capsule which is at inspection zone 58 while the spectral information transmitted by the optical cable 42 transmits to the spectrometer information received from the optical inspection zone 60.

FIG. 5 is a cross-sectional view taken along lines 5—5 of FIG. 4. Incidently, although the fiber optic bundle 62 is shown with conventional cross-sectioning representing glass, it would actually be a series of very fine fibers, if it were possible to reproduce such fibers in the drawing. The reference numerals 58 and 60 in FIG. 5 actually indicate the ends of a series of optical fibers at the inspection zones and include both some optical fibers which are supplying input illumination, and other optical fibers which are employed to transmit spectral information from the inspection zones back to the spectrophotometer.

Figure 7:
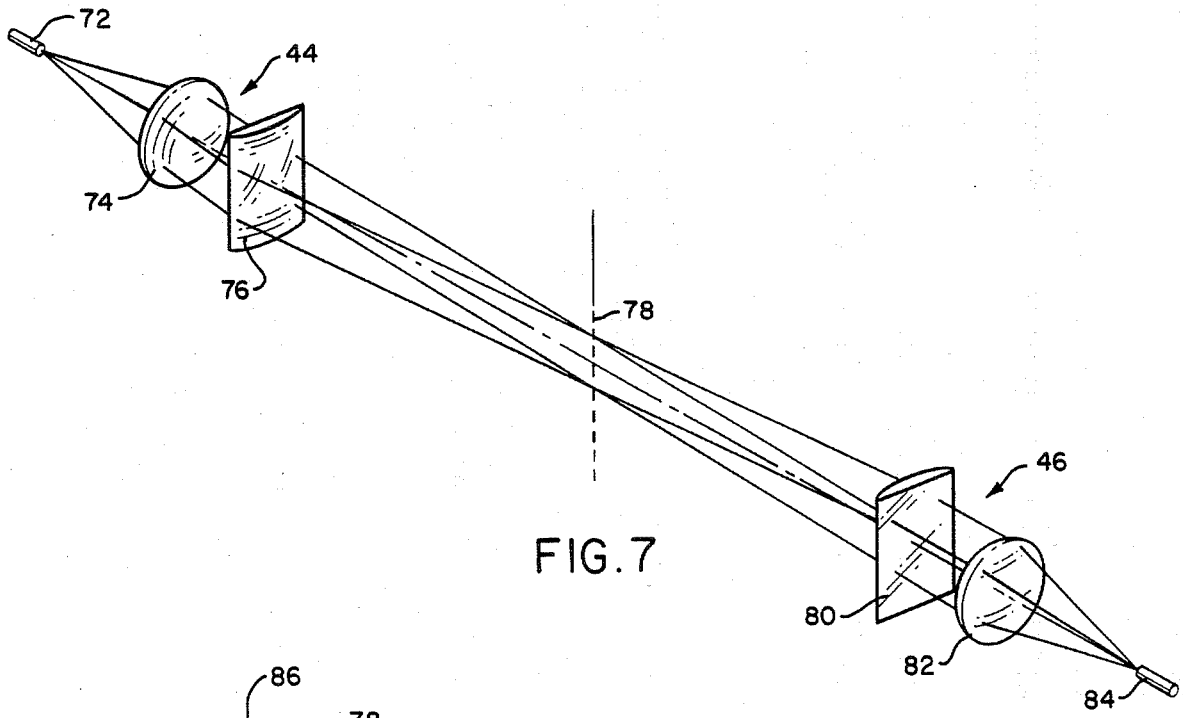
FIG. 7 is an isometric view of the optical system for providing a transverse planar light beam at the exit from the test block.
Figure 8:
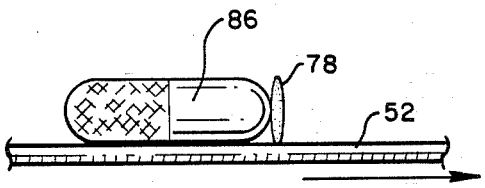
FIG. 8 is a schematic showing of a capsule in position to interrupt the light beam generated by the optics of FIG 7.

Referring now to FIG. 7 of the drawings, this figure shows in greater detail the nature of the optical system, including lens assemblies 44 and 46, which was mentioned briefly in connection with FIG. 2 of the drawings as providing a substantially planar, vertically extending light beam, at the output from the test block 34. The source of illumination 72, which may be a light emitting diode, is collimated by the lens 74 and is converged by the cylindrical lens 76 into a substantially vertically extending planar light beam at line 78. A similar set of lenses including the cylindrical lens 80 and the circular lens 82 converge the illumination from the zone 78 to the photo sensitive element 84, which may be a phototransistor or photo-diode. Accordingly, as indicated in FIG. 8, when the capsule 86 interrupts the light beam at the zone 78, a signal from the phototransistor 84 provides an input to the data processing system to sample the spectral output at zones 58 and 60 to inspect the colors of the two halves of the capsule 86.

In addition, a tachometer or pulse generator 88 (see FIG. 2) is coupled to the conveyor belt 52 and supplies signals to the data processor 28 to determine the speed of the conveyor belt, and the corresponding velocity of the capsules being moved by the belt. Using the time of interruption of the photo transistor 84 and the velocity of the conveyor belt, the length of the capsule may be readily calculated, and compared with predetermined length tolerances for the capsule.

Figure 9:
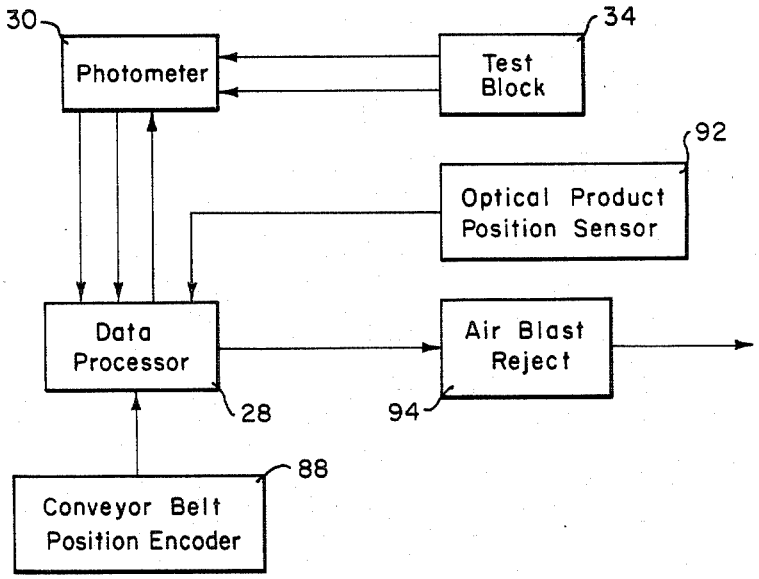
FIG. 9 is a schematic block diagram of the present system, illustrating the principles of the present invention.

FIG. 9 is an overall schematic block diagram showing the data processor 28, the inputs to the data processor including the results of the tests from the photometer 30, the input from the optical position sensor designated 92 in FIG. 9, and the output from the conveyor belt tachometer or position encoder 88. Incidently, the coupling from the test block 34 to photometer 30 is also shown in FIG. 9. An airblast reject block 94, which is implemented by a solenoid actuated valve, together with the air tube 48 as shown in FIG. 2, is the final block shown in FIG. 9 of the drawings. If the length of each capsule as determined by the foregoing measurement calculations does not fall within acceptable tolerances a signal will be provided by the processor to the airblast reject block to cause the capsule to be diverted from the acceptance path to the rejection path.

Initially, concerning the computer programs employed in the present data processing system, reference will be made to FIGS. 10, 11 and 12. With regard to the details of the program diagrams, the plain rectangular blocks represent actions to be taken, while the diamond shaped blocks, or the rectangles with pointed ends, represent decisions to be made or conditional branching points in the logic. In addition, the letter "F" refer to logical "Flags" or logical variables which will have one of two values such as "0" or "1" or "True" and "False".

Turning now to the "Inspect" schematic the initial block 102 is labelled "Inspect" indicating that the data processing system has been placed in the "Inspect" mode. The next diamond shaped block designated "F-DATA?" asks the question "Is there a new spectrum in memory to be evaluated?". If the answer if false, indicated by the letter "F" that there is no new data, the data processor returns to its "idle" state, as indicated by the block 106. If the answer to the inquiry of block 104 is true, indicating that new data has been received, we proceed to blocks 108 and 110, with block 108 indicating a reset of the flag to "False". Block 110 indicates that a color comparison is being made at one of the two spaced inspection zones, designated channel A and that this is being done relative to the color which would be located at this inspection zone designated channel A for one of the two possible orientations of the capsule, designated as the "positive" orientation of the capsule. The next diamond shaped block 112 inquires as to whether the spectral comparison lies within the predetermined permitted spectral tolerances. A negative answer to the question of block 112 leads us to action block 114 which requires that the spectral characteristics at channel A be compared with the other orientation of the capsule designated the "negative" orientation, which has been "Learned". The following question 116 asks whether the spectral characteristic was within the predetermined limits. If not, the eject block 118 is reached, requiring that the pneumatic rejection equipment which provides a blast of air through tube 48 occurs, with the capsule being ejected through the tube 26.

Continuing on the right hand channel in FIG. 10, a true answer to the question of diamond 116 leads to an action block 120 wherein the spectral signal from the other inspection zone designated channel "B" is compared with the spectral characteristic corresponding to the same negative orientation of the capsule. This step leads to the inquiry of diamond 122, asking whether the comparison was within the predetermined limits. If no, or "F", the eject action block 118 is again reached. However, if the spectral comparison is within the prescribed limits, point 124 is reached, and no ejection of the capsule occurs.

As part of the "fail-safe" mode of operation of the present system, it is initially assumed that the capsule is "bad" and needs to be ejected, unless the logic indicates otherwise. The action block 126 indicates the step of reversing the initial assumption that the capsule is bad, and thus permitting the capsule to flow through to the acceptance chute 24 as shown in FIG. 2. As indicated by the "idle" block 128, after a capsule has either been ejected or permitted to reach the acceptance bin, the data processor is reset to its idle state.

Now, returning to the output of the inquiry of diamond 112, a "True" output leads us to the action block 130. We have determined by the inquiry 112 that the color has matched at the inspection zone designated by channel A; and action block 130 now inquires as to whether the color at the other inspection zone designated "Channel B" is correct. This inquiry of whether it is within the appropriate predetermined tolerance is asked by the diamond 132. A true response leads us to point 124 and the action discussed hereinabove. Conversely, a false answer leads to the eject action block 134 causing the pneumatic ejection or rejection equipment to operate.

Turning now to FIG. 11, this is the "learn" mode, and is entered at block 136 when the date processor is placed in the learn mode. The data processor is placed in the "learn" mode when it is desired to prepare to inspect a new type of capsule. As an initial step a substantial number such as 64 of the capsules having the proper color combinations are fed through the apparatus while it is in the learn mode. The program schematic as shown in FIG. 11 indicates the steps in storing the necessary data which is later employed in the "inspect" mode discussed hereinabove.

The first diamond 138 following the initial block 136 asks the question "Do we need to initialize?" A true or "Yes" answer leads to the setting of a number of flags in the data processor as indicated by the large block 140 including a number of entries. Considering these entries in sequence, the top line indicates that there is no further need to initialize as that is being accomplished at this time. The second and third lines in block 140 indicate, respectively, that no positive orientation capsules have been sampled as yet and that no negative orientation capsules have been examined. Incidentally, the first capsule is by definition the orientation which will be considered "positive"; and the reverse orientation will be the "negative" orientation. The learn sequence involves sampling of 16 capsules of each orientation, and the next two lines F-PDUN and F-NDUN, both set equal to "False", indicate that we have not as yet seen 16 samples of either orientation. The next three lines in block 140 indicate the count, with the count for negative orientation capsules being zero, the count for positive orientation capsules, designated by the letter "N" also being equal to zero, and of course the total count of capsules used in the learn mode, designated by the letter "C", also being equal to zero.

The next diamond 142 inquires as to whether a capsule is available for color analysis, and if not, the data processor shifts to the idle state as indicated by the block 144. A true answer from the diamond 142, indicating that data is present, or that a capsule has interrupted the light beam, leads us to the block 146 where the count is incremented by one unit, and the flag for presence of data is switched to false, as we are now processing this initial data. The next diamond 148 asks the question as to whether the total count is less than 64. This is accomplished by the step indicated by diamond 148. If the answer is false, indicating that we have reached a count of 64 (and we have not had 16 counts for each orientation) then the block 150 and step 152 indicates that there has been an error in the learn process, and that the machine is stopped in order for the nature of the error to be determined.

A true answer to the question of diamond 148 leads to the diamond 151 which asks the question "have we seen any positive capsules?". In this regard it is noted again that the first capsule will arbitrarily be designated as the positive orientation of the capsules. A false answer means that this is the first capsule and thus the first positive capsule that has been observed by the data processor, and leads to the action 153 which indicates that we have now seen the first capsule and that this is a positive capsule and the flag representing this state is set to the true value. The next step as indicated by the block 154 is the accumulation of the number of counts of positive orientation capsules. As indicated by the last line in block 154 when the count reaches 16, that is all of the samples of that orientation which are to be taken, and the flag for F-PDUN is set TRUE.

Block 156 which is below the diamond 151 indicates that the action to be taken is to compare the new data with the initial positive sample data previously recorded. The next question asked by diamond 158 is if the new sample is within the allowed tolerance as far as spectral distribution and length is concerned. A true answer leads to the diamond 160 inquiring as to whether the count of 16 has been reached. If not, the block 154 is again accessed and the count of the positive samples is incremented to one higher count.

Returning to diamond 158, a false answer, indicating that there was not a match with the original positive orientation data, leads to diamond 162 which inquires as to whether we have previously had a negative orientation. Incidentally, the lower left hand sequence as shown in this FIG. 11 is similar to the sequence which followed the diamond 151 relative to the positive orientation. Accordingly, at the lower left, we have block 164 in which the accumulated count for the negative orientation is accomplished following the action block 166. The action block 168 indicates that successive negative orientations are compared with the original negative orientation, and the diamond 170 inquires as to whether or not they are within the prescribed tolerance. A false answer to this inquiry leads us to the idle state of the data processor as indicated by block 172. A match leads us to diamond 174 inquiring as to whether we have previously had 16 counts of the negative orientation, and if not we proceed to accumulate an additional count through block 164. On the other hand if a count of 16 has already been reached so that F-NDUN is TRUE, we proceed to the point 176 leading to the next inquiry indicated by the diamond 178, which inquires whether we have had 16 samples of both the positive and negative orientation, and if this is true the block 180 indicates the next successive steps of normalization, averaging, and setting the data processor over to the inspect mode. Incidentally, it may be noted that the average spectrum now becomes the standard against which additional capsules are tested during the inspect mode. If we have not received 16 samples of both types, we revert to the idle mode as indicated by the block 182 and wait for additional capsules to arrive.

Following reset to the inspect mode as indicated by the last line of block 180 we shift to the idle state in the inspect mode as indicated by the block 184. Of course, the inspect mode has been reviewed above in connection with FIG. 10 of the drawings.

Turning now to FIG. 12, several important interrupts involved in the data processing system will now be considered. The first, indicated by the block 192 indicates that the leading edge of the capsule has interruped the light beam. This causes the actions indicated within the block 194 including "start integration" which involves the exposure of the spectrophotometers by the output from the fiber optic sensors associated with the sensing zones. The second line of block 194 indicates that the exposure time for the spectrophotometers is initiated. The final line of block 194 indicates that the flag F-BAD is set to the "TRUE" state.

Turning now to the second interrupt in FIG. 12, this involves the fact that the trailing edge of the capsule has passed, indicated by the block 196, and relates to the fact that the phototransistor has now been turned back on. Proceeding to the right hand block 197 in FIG. 12, the initial question indicated at the top of the block is whether the data processor is in the inspect mode. If the answer to this inquiry is false, then the lower right hand side of block 197 indicates that the capsule will be disposed of as requested by the user. Thus for example, the user may elect to reject or eject all capsules during the learn mode. In the event that the answer to the inquiry in the top line of block 197 is true, this means that the data processor is in the inspect mode, and we proceed to the next line on the left hand side of block 197 asking if F-BAD is TRUE. If this is correct, then the capsule is ejected. However, if this is false, the capsule is not ejected and is passed through with the other good capsules.

The next interrupt included in FIG. 12 involves the block 198 designated "Exposure Complete". Following completion of the exposure, the spectral data is directly transferred into a memory with the letters "DMA" indicating "direct memory access", and indicated by the right hand block 200.

The next interrupt as shown in FIG. 12 by block 202 is labelled "DMA complete", indicating that the spectral data has been transferred directly into memory. As this time, as indicated by block 204 the data processor flag "F-DATA=TRUE" is set to indicate that data is present, as indicated by the legend within block 204.

The foregoing completes the description of the data processing program.

Reference will now be made to FIG. 13 which shows a typical "learned" spectrum 222 which is the result of the averaging of 16 samples during the "learn" mode. The spectral output from a capsule being inspected or tested is indicated by dashed line 224, and this is sufficiently close to the learned spectral characteristic 222 that a positive output would be provided from the data processor indicating that the capsule was within limits. On the other hand, a characteristic such as that shown at 226 by the dotted characteristic would not be sufficiently close to the learned curve 222 to be accepted. Of course, the color indicated by the spectral pattern 226 could be the color of the opposite end of the capsule, and it would then be subject to matching with an alternative characteristic, associated with the reverse capsule orientation. In FIG. 13, the spectrum may extend throughout the visible range from approximately 4,000 angstrom units up to approximately 7,000 angstrom units, with the vertical axis in FIG. 13 representing relative amplitude.

For completeness, it may be noted that the high speed spectrophotometer 130 may be implemented by the $PR_{820}$ Spectrophotometer, available from the Vision Systems Group of Photo Research, a Division of Kollmorgen Corporation, 3099 North Lima Street, Burbank, Calif. 91504. It is also noted that the hopper, rotary table, and conveyor may be obtained from the Food Machinery Company.

In conclusion, it is to be understood that the foregoing detailed description and the accompanying drawings relate to a preferred illustrative embodiment of the invention. However, the principles of the invention may be implemented by alternative constructions. Thus, by way of example, and not of limitation, the capsules may be physically dropped one by one through a circular or rectangular elongated opening, in a test block and verified in the course of transit, instead of while being conveyed through a slot. Also, instead of pneumatic ejection or rejection of non-matching objects, a mechanical rejection mechanism may be employed. Accordingly, the present invention is not limited to the specific construction as shown in the drawings and as set forth in the foregoing detailed description.

What is claimed is:

1. A verification system for capsules, tablets or similar small objects, comprising:

a test block having a slot extending through the block;

conveyor means for directing the objects under test through said slot;

means for providing first and second longitudinally spaced color testing zones in said test block, said means including fiber optic arrays at the top and both sides of said slot at each of said two zones;

means for directing light to all six of the fiber optic arrays;

high speed spectrophotometer means coupled to receive light having spectral characteristics conforming to that of said object from all three fiber optic arrays at said first zone, and separately from all these arrays at said second zone;

means for comparing said sensed spectral characteristics with predetermined spectral characteristics;

means for initially directing all objects leaving said test block along an "acceptance" path; and means for diverting objects having spectral characteristics which do not match said predetermined spectral characteristics from said "acceptance" path to a "rejection" path.

2. A verification system as described in claim 1 further comprising:

means for providing a substantially planar light beam extending transverse to and across the path of the objects to be tested passing through said slot;

light sensor means for determining when said planar light beam is interrupted;

means for providing an indication of the speed at which said objects are travelling;

means for determining the length of said objects and whether said objects are within a predetermined length range; and means for selectively actuating said means for diverting objects to the "rejection" path if the length of the objects is not within the predetermined length range.

3. A verification system as described in claim 2 wherein means are coupled to said light sensor means for timing the sensing of the color of two different sections of said object at said two zones upon interruption of said planar light beam.

4. A system as defined in claim 2 wherein said means for providing a planar light beam includes at least one circular and one cylindrical lens.

5. A system as defined in claim 2 including means coupled to said conveyor means for providing output pulses indicative of the speed of said conveyor means.

6. A verification system as defined in claim 1 wherein said system includes:

means for storing two predetermined spectral characteristics for identifying the two ends of said object under test; and means for directing objects along the "acceptance" path if the object under test has matches for the two spectral distributions, regardless of the physical orientation of the objects under test relative to said first and second testing zones.

7. A system as defined in claim 1 wherein said system includes pneumatic means for selectively diverting said objects from said "acceptance" path to said "rejection" path.

8. A verification system for capsules, tablets or similar small objects, comprising:

a test block having an opening extending through the block;

means for directing the objects under test through said opening;

means for providing first and second longitudinally spaced color testing zones in said test block, said means including fiber optic arrays at least at two opposed sides of said opening at each of said two zones;

means for directing light to each of the fiber optic arrays;

high speed spectrophotometer means coupled to receive light having spectral characteristics conforming to that of said object from at least said two fiber optic arrays at said first zone, and separately from at least said two opposed arrays at said second zone;

means for comparing the sensed spectral characteristics with predetermined spectral characteristics;

means for initially directing all objects leaving said test block along an "acceptance" path; and means for diverting objects having spectral characteristics which do not match said predetermined spectral characteristics from said "acceptance" path to a "rejection" path.

9. A verification system as described in claim 8 further comprising:

means for providing a substantially planar light beam extending transverse to and across the path of the objects to be tested passing through said opening;

light sensor means for determining when said planar light beam is interrupted;

means for providing an indication of the speed at which said objects are travelling;

means for determining the length of said objects and whether said objects are within a predetermined length range; and means for selectively actuating said means for diverting objects to the "rejection" path if the length of the objects is not within the predetermined length range.

10. A verification system as described in claim 9 wherein means are coupled to said light sensor means for timing the sensing of the color of two different sections of said object at said two zones upon interruption of said planar light beam.

11. A system as defined in claim 9 wherein said means for providing a planar light beam includes at least one circular and one cylindrical lens.

12. A verification system as defined in claim 8 wherein said system includes:

means for storing two predetermined spectral characteristics for identifying the two ends of said object under test; and means for directing objects along the "acceptance" path if the object under test has matches for the two spectral distributions, regardless of the physical orientation of the objects under test relative to said first and second testing zones.

13. A system as defined in claim 8 wherein said system includes pneumatic means for selectively diverting said objects from said "acceptance" path to said "rejection" path.

14. A system as defined in claim 8 further comprising data processing means for receiving signals from said spectrophotometer means, and selectively controlling the path of said objects along said "acceptance" path or to said "rejection" path.

15. A verification system for capsules, tablets or similar small objects comprising:

a test assembly having an opening extending through the assembly;

means for directing the objects under test through said opening;

means for providing first and second longitudinally spaced color testing zones in said test block, said means including fiber optic arrays at least at two opposed sides of said opening at each of said two zones;

means for directing light to each of said fiber optic arrays;

high speed spectrophotometer means coupled to receive light having spectral characteristics conforming to that of said object from at least two opposed fiber optic arrays at said first zone, and separately from at least said two opposed arrays at said second zone;

means for comparing the sensed spectral characteristics with predetermined spectral characteristics;

means for initially directing all objects leaving said test assembly along an "acceptance" path;

means for diverting objects having spectral characteristics which do not match said predetermined spectral characteristics from said "acceptance" path to a "rejection" path;

means for providing a substantially planar light beam extending transverse to and across the path of the objects to be tested passing through said opening;

light sensor means for determining when said planar light beam is interrupted; means for providing an indication of the speed at which said objects are travelling;

means for determining the length of said objects and whether said objects are within a predetermined length range; and means for selectively actuating said means for diverting objects to the "rejection" path if the length of the objects is not within the predetermined length range.

16. A verification system as described in claim 15 wherein means are coupled to said light sensor means for timing the sensing of the color of two different sections of said object at said two zones upon interruption of said planar light beam.

17. A verification system as defined in claim 15 wherein said system includes:

means for storing two predetermined spectral characteristics for identifying the two ends of said objects under test; and means for directing objects along the "acceptance" path if the object under test has matches for the two spectral distributions, regardless of the physical orientation of the objects under test relative to said first and second testing zones.

18. A system as defined in claim 15 wherein said system includes pneumatic means for selectively diverting said objects from said "acceptance" path to said "rejection" path.

19. A system as defined in claim 15 wherein said means for providing a planar light beam includes at least one circular and one cylindrical lens.

* * * * *